US007087824B2

(12) United States Patent
Szynal

(10) Patent No.: US 7,087,824 B2
(45) Date of Patent: Aug. 8, 2006

(54) DEVICE FOR STRIKING A PERCUSSION INSTRUMENT

(76) Inventor: Matthew J. Szynal, 5517 Avenue F, Austin, TX (US) 78751

( * ) Notice: Subject to any disclaimer, the term of this patent is extended or adjusted under 35 U.S.C. 154(b) by 0 days.

(21) Appl. No.: 10/636,719

(22) Filed: Aug. 7, 2003

(65) Prior Publication Data

US 2004/0025665 A1 Feb. 12, 2004

Related U.S. Application Data

(60) Provisional application No. 60/401,994, filed on Aug. 8, 2002.

(51) Int. Cl.
*G10D 13/08* (2006.01)

(52) U.S. Cl. ..... 84/402

(58) Field of Classification Search ..... 84/402–409
See application file for complete search history.

(56) References Cited

U.S. PATENT DOCUMENTS

| | | | | |
|---|---|---|---|---|
| 1,453,968 | A * | 5/1923 | Bartholomae | 446/422 |
| 6,172,289 | B1 * | 1/2001 | Shelley | 84/411 R |
| 6,825,407 | B1 * | 11/2004 | Curren | 84/402 |
| 2003/0024374 | A1 * | 2/2003 | Davies | 84/402 |

OTHER PUBLICATIONS

Cowbell slapper adjustable, last modified Jun. 21, 2002 from internet search, see attached.*

* cited by examiner

*Primary Examiner*—Kimberly Lockett
(74) *Attorney, Agent, or Firm*—Polster Lieder Woodruff & Lucchesi, L.C.

(57) ABSTRACT

The present invention relates to a striker device for striking the playing surface of a percussion instrument. The striker device includes a flexible slapper plate upon which a ball is mounted. A means for adjustably mounting the striker device allows it to be mounted onto a rod of the percussion instrument such that the movement of the rod causes the slapper plate to oscillate causing the ball to strike the playing surface of the percussion instrument.

20 Claims, 1 Drawing Sheet

DEVICE FOR STRIKING A PERCUSSION INSTRUMENT

CROSS-REFERENCE TO RELATED APPLICATIONS

This application is related to U.S. Provisional Patent Application Ser. No. 60/401,994 filed Aug. 8, 2002 from which priority is claimed.

STATEMENT REGARDING FEDERALLY SPONSORED RESEARCH OR DEVELOPMENT

Not Applicable.

BACKGROUND OF THE INVENTION

Percussionists use a wide variety of percussion instruments. Not only do these musicians use the standard snare drum, bass drum, and other types of instruments with drawn heads, percussionists also use a wide range of other instruments such as chimes, cymbals, and cow bells. Because the percussionist wishes to play as many instruments as he can, many of these instruments have been design to be played without requiring the percussionist to use one of the hand striking motions of the musician to strike the instrument with a drumstick.

In normal use, virtually all of these instruments, with the possible exception of a hi-hat cymbal, require the musician to strike the instrument with some type of drum stick or mallet. This is especially true of the cow bell. The cow bell is usually placed in near proximity to the percussionist such that when the cow bell is to be played, the percussionist strikes the cow bell with at least one of his drumsticks.

SUMMARY OF THE INVENTION

The present invention resides in a striker that can be mounted near a percussion instrument such that the instrument can be played without striking the instrument with a drum stick. Instead, the percussion instrument is played by placing the striker near the instrument to be struck, and then moving the striker in such a manner that the flexible nature of the striker will allow a ball on the striker to come into striking contact with the percussion instrument.

Additional features of the present invention will be in part apparent and in part pointed out hereinafter.

BRIEF DESCRIPTION OF THE SEVERAL VIEWS OF THE DRAWINGS

In the drawings, wherein like numerals and letters refer to like parts wherever they occur.

Corresponding reference characters indicate corresponding parts throughout the several views of the drawings.

While one embodiment of the present invention is illustrated in the above referenced drawings and in the following description, it is understood that the embodiment shown is merely for purpose of illustration and that various changes in construction may be resorted to in the course of manufacture in order that the invention may be utilized to the best advantage according to circumstances which may arise, without in any way departing from the spirit and intention of the invention, which is to be limited only in accordance with the claims contained herein.

DETAILED DESCRIPTION

Figure 1:
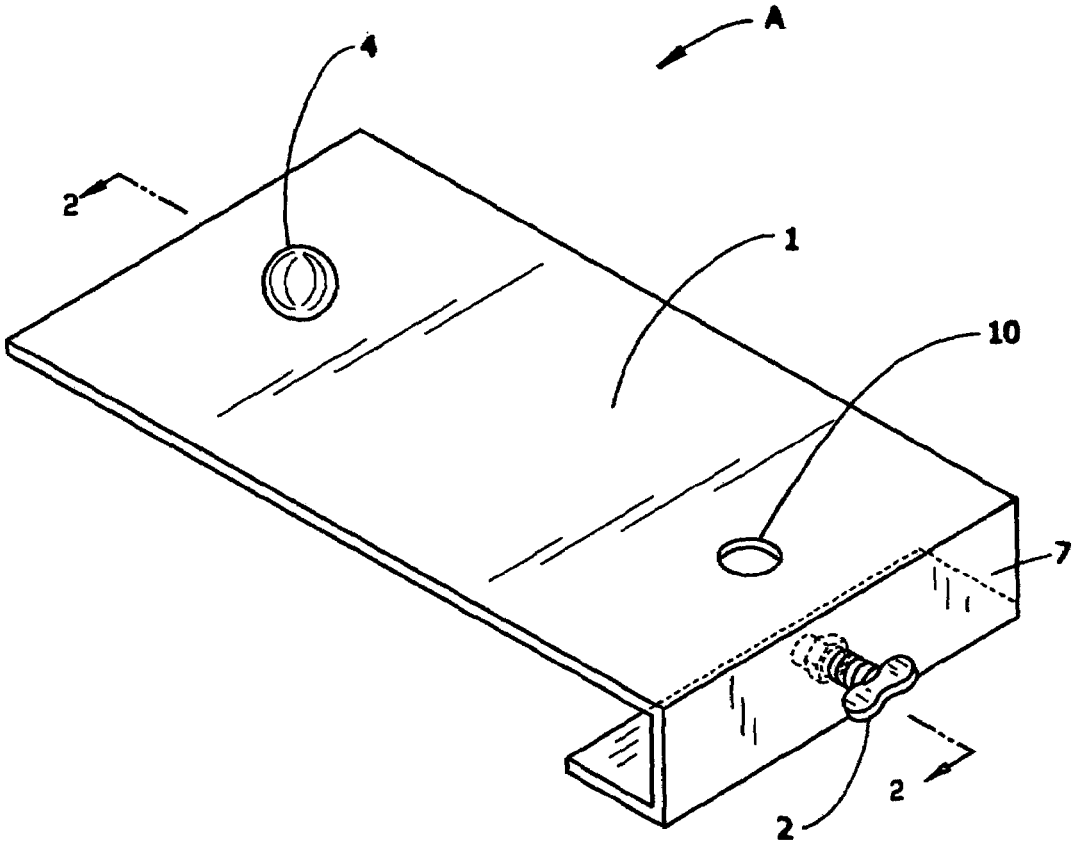
FIG. 1 is a perspective view of one embodiment of the present invention.

In one embodiment of the present invention, the striker device A is constructed as shown in FIG. 1. The striker device A includes a slapper plate 1, a thumb screw 2, a nut 3, and a ball 4. The slapper plate 1 is preferably made from formable metal, but may also be made of any other material that is capable of providing the flexibility needed to allow the striker device A to function properly. The slapper plate 1 is generally channel-shaped with a leg 5 of the channel greatly extended. In fact, the leg 5 is preferred to be about 6.00 inches in length. The shorter leg 6 of the channel is about 1.00 inch in length, and the web 7 of the channel is about 1.00 inch in height. The width of the leg 5, the leg 6, and the web 7 are normally the same in one embodiment, which is about 2.00 inches. The width of each of three elements, however, need not be the same. Also, notwithstanding the dimensions indicated for leg 5, leg 6, and web 7, the dimensions for each of these three elements can be adjusted as needed to match the instrument being played and/or the method of mounting the instrument and the striker device A.

A ball 4 is attached to the outside surface of the leg 5. The ball 4 can be of any material, but in the present embodiment, the ball 4 is constructed of metal. The ball 4 may be attached to the leg 5 by welding, gluing, or any other method of attachment which adequately secures the ball 4 to the leg 5. The ball 4 is positioned about 5.50 inches from the web 7 and on the center line of the width of the leg 5. In other embodiments, the ball 4 can be positioned as required to cause the striker device A to be capable of striking any particular percussion instrument selected by the musician.

Figure 2:
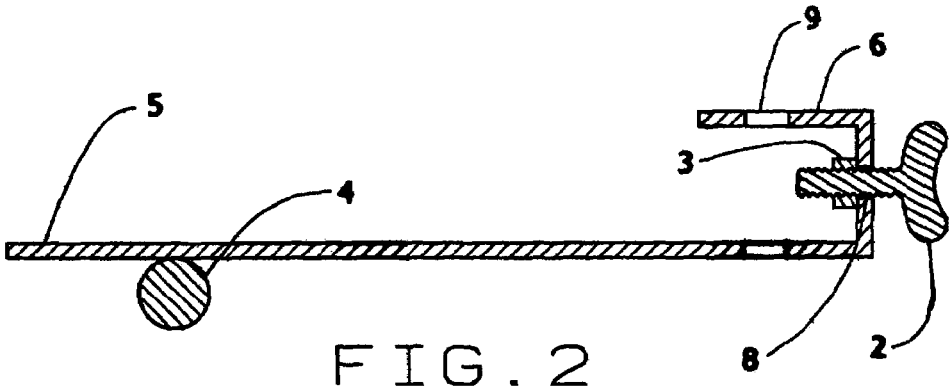
FIG. 2 is a sectional view of one embodiment of the present invention.

Referring now to FIG. 2, the present embodiment includes a opening 8 located on the vertical and horizontal centerlines of the web 7. A nut 3 is located in axial alignment with the opening 8, the nut 3 being positioned on the inside of the channel formed by the leg 5, the leg 6, and the web 7. The nut is welded to the web 7. A thumb screw 2 is inserted through the opening 8 and threaded into the nut 3. In other embodiments, the nut 3 can be glued or otherwise attached to the web 7. In yet other embodiments, nut 3 is not used and instead the opening 8 in the web 7 is threaded to match the threads of the thumb screw 2. Additionally, while the presented embodiment uses a thumb screw 2, other fasteners such as hex head bolts, round head screws, or other threaded fasteners may be used provided the fastener has the ability to be threaded into, and out of, the nut 3 or threaded opening 8.

A first opening 9 is located in the leg 5 such that the first opening 9 is on the longitudinal centerline of the leg 5 and about 0.50 inch from the corner formed by the intersection of the leg 5 with the web 7. A second opening 10 is located on the longitudinal and transverse centerlines of the leg 6 and is also about 0.50 inch from the corner formed by the intersection of the leg 6 and the web 7. The diameter of the openings 9 and 10 are sized to slideably match the vertical rod onto which the striker device A is to be mounted. Because the vertical rod must simultaneously pass through the first opening 9 and the second opening 10, the first opening 9 and the second opening 10 must be in general axial alignment The thickness of the leg 6, the leg 5, and the web 7 is obtained by determining the amount of flexure required of the striker device A. For instance, it will be appreciated that a striker device A which is made from about 0.125 inch thick mild steel will have less flexure than a striking device A made from 0.0625 inch thick mild steel. Thus, the thickness of the material is dependent upon the amount of flexure desired and the material used. In any case, however, the material used and the thickness of the material used must be such that the striker device A has enough flexure to allow the striking device to bounce sufficiently when installed such that the ball 4 strikes the percussion instrument in the manner and style selected by the musician.

In one embodiment, the present invention may be used as a striker to strike a cow bell. In that embodiment, the cow bell is installed onto a cow bell stand which is normally a vertical metal rod having an attachment mechanism at the top of the vertical rod to hold the cow bell onto the top of the rod. In such installations, the cow bell is oriented in a horizontal manner; that is, the large opening of the cow bell is positioned horizontally. In this way, the sides of the cow bell are also horizontal and are perpendicular to the vertical metal rod.

The striker device A is installed on the vertical metal rod by inserting the vertical metal rod through the opening 9 and the opening 10. Depending on the choice of sound desired by the musician, the striker device A can be installed above or below the cow bell. The thumb screw 2 is then rotated to move the threaded end of the thumb screw 2 into contact with the outer surface of the vertical metal rod. By further tightening the thumb screw 2, the striker device A is secured to the vertical metal rod. The position of the striker device A can be adjusted by loosening the thumb screw 2, sliding the striker device A up or down as desired on the vertical metal rod, and then retightening the thumb screw 2.

In operation, the striking device A is positioned on the vertical metal rod as described above such that the ball 4 is against or near the horizontal surface of the cow bell. Then, by manipulation of the vertical metal rod, the flexing nature of the striking device A will allow the leg 5 to bounce. In this manner, a musician can "slap" the plate 1 by hand to cause the ball 4 to strike the cow bell. In another embodiment, the cow bell and the striker device A can be positioned on a hi-hat vertical mounting rod such that the vertical activation of the vertical rod by the foot pedal of the hi-hat assembly will allow the striker device A to bounce up and down vertically while keeping the cow bell in a fixed position. The vertical motion of the striker device A causes the ball 4 to strike the horizontal surface of the cow bell.

While the above description describes various embodiments of the present invention, it will be clear that the present invention may be otherwise easily adapted to fit any configuration where a striking device for striking any percussion instrument may be utilized. As various changes could be made in the above constructions without departing from the scope of the invention, it is intended that all matter contained in the above description or shown in the accompanying drawings shall be interpreted as illustrative and not in a limiting sense.

What is claimed is:

1. A striker for a percussion instrument comprising:

a slapper plate having at least one opening for mounting the slapper plate to a percussion instrument, the slapper plate being made from a material capable of allowing the slapper plate to have flexibility adequate to allow the striker to strike the percussion instrument, the slapper plate being generally channel-shaped having a web wherein a first leg of the channel extends longer than a second leg and wherein widths of the first leg, the second leg, and the web are about the same;

a fastener for attaching the slapper plate to the percussion instrument, the fastener includes a first opening located on the vertical and horizontal centerlines of the web, and a means for fastening the striker to a vertical rod member of the percussion instrument; and a metal ball mounted to an outside surface of the first leg of the slapper plate such that the metal ball strikes the percussion instrument in response to movement of the slapper plate.

2. A striker for a percussion instrument comprising:

a slapper plate made from a material capable of allowing the slapper plate to have flexibility adequate to allow the striker to strike the percussion instrument, the slapper plate being generally channel-shaped having a web wherein a first leg of the channel extends longer than a second leg and wherein widths of the first leg, the second leg, and the web are about the same;

a means for adjustably attaching the slapper plate to the percussion instrument wherein the means for adjustably attaching the slapper plate to the percussion instrument includes a first opening located on the vertical and horizontal centerlines of the web, and a means for fastening the striker to a vertical rod member of the percussion instrument; and a metal ball mounted to an outside surface of the first leg of the slapper plate such that the metal ball strikes the percussion instrument in response to movement of the slapper plate.

3. The striker for a percussion instrument of claim 2 wherein the first leg is about 6.00 inches in length.

4. The striker for a percussion instrument of claim 3 wherein the second leg is about 1.00 inches in length and a web of the channel shape of the slapper plate is about 1.00 inches in height.

5. The striker for a percussion instrument of claim 2 wherein the width of the first leg, the second leg, and the web is about 2.00 inches.

6. The striker for a percussion instrument of claim 2 wherein the metal ball is attached to the first leg such that the metal ball is positioned about 5.50 inches from the web and on the centerline of the width of the first leg.

7. The striker for a percussion instrument of claim 2 wherein the means for adjustably attaching the slapper plate to the percussion instrument further includes a thumb screw located within the first opening and means for adjusting the thumb screw axially within the first opening.

8. The striker for a percussion instrument of claim 7 wherein the means for adjusting the thumb screw axially within the opening includes one of either threading the first opening to match the threads of the thumb screw or installing a nut located in axial alignment with the first opening, the nut being attached to an inside surface of the web.

9. The striker for a percussion instrument of claim 8 wherein the means for adjustably attaching the slapper plate to the percussion instrument includes a second opening located on the longitudinal centerline of the first leg and about 0.50 inch from the corner formed by the intersection of the first leg with the web, and further includes a third opening located on the longitudinal and transverse centerlines of the second leg about 0.50 inch from the corner formed by the intersection of the second leg and the web, wherein the diameter of the first opening and the second opening are sized to slideably match the vertical rod onto which the striker is mounted and wherein the second opening and the third opening are in general axial alignment.

10. The striker for a percussion instrument of claim 9 wherein the thickness of each of the first leg, the second leg, and the web is obtained by determining a flexure rate required to allow the metal ball to adequately strike the percussion instrument on which the striker is mounted.

11. A process of providing a striker for a percussion instrument comprising the steps of:

providing a slapper plate made from a material capable of providing the flexibility needed to allow the striker to function properly wherein the slapper plate has a general channel shape having a web wherein a first leg of the channel extends longer than a second leg;

providing means for attaching the slapper plate to the percussion instrument wherein the means for attaching the slapper plate to the percussion instrument includes the step of providing the slapper plate with a first opening located on the vertical and horizontal centerlines of the web and a means for fastening the striker to a vertical rod member of the percussion instrument; and providing a metal ball mounted to an outside surface of the slapper plate such that the metal ball will strike the percussion instrument.

12. The process of striking a percussion instrument in claim 11 further including the step of making the first leg about 6.00 inches in length.

13. The process of striking a percussion instrument in claim 12 further including the step of making the second leg about 1.00 inch in length and the web of the channel shape of the slapper plate about 1.00 inch in height.

14. The process of striking a percussion instrument in claim 13 further including the step of providing a slapper plate wherein the width of the first leg, the second leg, and the web is about 2.00 inches.

15. The process of striking a percussion instrument in claim 14 wherein the metal ball is attached to the first leg such that the metal ball is positioned about 5.50 inches from the web and on the centerline of the width of the first leg.

16. The process of striking a percussion instrument in claim 11 wherein the means for fastening the striker to a vertical rod member of the percussion instrument includes a thumb screw located within the first opening and means for adjusting the thumb screw axially within the first opening.

17. The process of striking a percussion instrument in claim 16 wherein the means for adjusting the thumb screw axially within the opening includes one of either threading the first opening to match the threads of the thumb screw or attaching a nut located in axial alignment with the first opening, the nut being attached to an inside surface of the web.

18. The process of striking a percussion instrument in claim 17 wherein the means for fastening the striker to a vertical rod of the percussion instrument includes a second opening located on the longitudinal centerline of the first leg and about 0.50 inch from the corner formed by the intersection of the first leg with the web, and further includes a third opening located on the longitudinal and transverse centerlines of the second leg about 0.50 inch from the corner formed by the intersection of the second leg and the web, wherein the diameter of the first opening and the second opening are sized to slideably match the vertical rod onto which the striker is mounted, and wherein the second opening and the third opening are in general axial alignment.

19. The process of striking a percussion instrument in claim 18 wherein the thickness of each of the first leg, the second leg, and the web is obtained by determining a flexure rate required to allow the ball to adequately strike the percussion instrument on which the striker is mounted.

20. A process of striking a percussion instrument comprising the steps of:

providing a striker for a percussion instrument, the striker comprising:

a slapper plate made from a material capable of allowing the slapper plate to have flexibility adequate to allow the striker to strike the percussion instrument, the slapper plate being generally channel-shaped having a web wherein a first leg of the channel extends longer than a second leg and wherein widths of the first leg, the second leg, and the web are about the same;

a means for adjustably attaching the slapper plate to the percussion instrument wherein the means for adjustably attaching the slapper plate to a percussion instrument includes a first opening located on the vertical and horizontal centerlines of the web, and a means for fastening the striker to a vertical rod member of the percussion instrument;

a metal ball mounted to an outside surface of the first leg of the slapper plate such that the metal ball strikes the percussion instrument in response to the flexing movement of the slapper plate;

installing the striker onto a rod of the percussion instrument by positioning the striker on the rod such that the metal ball is against or near a striking surface of the percussion instrument; and manipulating the rod of the percussion instrument in a manner that allows the flexing nature of the slapper plate to cause the slapper plate to oscillate and cause the metal ball to strike the striking surface of the percussion instrument.

* * * * *